US008672152B2

(12) United States Patent
Nibouar et al.

(10) Patent No.: US 8,672,152 B2
(45) Date of Patent: Mar. 18, 2014

(54) CASTING PROCESS FOR RAILCAR COUPLER THROWERS

(75) Inventors: F. Andrew Nibouar, Chicago, IL (US); Jerry R. Smerecky, Roselle, IL (US); Kelly S. Day, Sparta, MI (US); Noland Brooks, Muskegon, MI (US)

(73) Assignee: Bedloe Industries LLC, Wilmington, DE (US)

( * ) Notice: Subject to any disclaimer, the term of this patent is extended or adjusted under 35 U.S.C. 154(b) by 223 days.

(21) Appl. No.: 13/250,148

(22) Filed: Sep. 30, 2011

(65) Prior Publication Data

US 2013/0082021 A1 Apr. 4, 2013

(51) Int. Cl.
*B61G 3/00* (2006.01)
*B22C 9/22* (2006.01)

(52) U.S. Cl.
USPC ..... 213/75 R; 164/244

(58) Field of Classification Search
USPC ..... 213/75 R, 127; 164/6, 15, 244
See application file for complete search history.

(56) References Cited

U.S. PATENT DOCUMENTS

| | | | | |
|---|---|---|---|---|
| 5,163,391 | A | 11/1992 | Green et al. | |
| 6,427,755 | B1 * | 8/2002 | Buckley | 164/132 |
| 2007/0125510 | A1 * | 6/2007 | Mautino et al. | 164/137 |
| 2009/0289022 | A1 * | 11/2009 | Smerecky et al. | 213/151 |
| 2009/0294395 | A1 | 12/2009 | Smerecky | |
| 2011/0168655 | A1 * | 7/2011 | Nibouar et al. | 213/100 R |

FOREIGN PATENT DOCUMENTS

| | | | |
|---|---|---|---|
| CN | 201 102 057 | Y | 8/2008 |
| JP | 05-023827 | A | 2/1993 |
| JP | 2004 017099 | A | 1/2004 |
| JP | 2004 025210 | A | 1/2004 |
| KR | 10-2010-0054795 | | 5/2010 |
| WO | WO 2011-084992 | A1 | 7/2011 |

OTHER PUBLICATIONS

Invitation to Pay Additional Fees (Form PCT/ISA/206) and Annex to Form PCT/ISA/206 for International Application No. PCT/US2012/048002, dated Oct. 25, 2012, 9 pages.
International Search Report and Written Opinion in corresponding application PCT/US2012/056895, mailed Feb. 27, 2013, 10 pages.

* cited by examiner

*Primary Examiner* — S. Joseph Morano
*Assistant Examiner* — Zachary Kuhfuss
(74) *Attorney, Agent, or Firm* — Nathan O. Greene; Brinks Gilson & Lione

(57) ABSTRACT

A method for casting a thrower for a railcar coupler includes creating a mold box that is vertically parted in halves, each half defining a side of a thrower cavity and that includes at least a portion of a sprue at a location above the thrower cavity, the thrower cavity also being oriented vertically; pouring molten metal into the mold box through the sprue and into the thrower cavity while the mold is oriented vertically; and shaking out the mold box to release the thrower after the thrower has cooled. Creating the mold box may be executed through a cold shell process. The halves of the mold box may include reflective images of the sides of two thrower cavities and an ingate connected between the sprue and one of the two thrower cavities.

17 Claims, 6 Drawing Sheets

CASTING PROCESS FOR RAILCAR COUPLER THROWERS

BACKGROUND

1. Technical Field

The present embodiments relate generally to the field of railroad couplers, and more specifically, to the casting of coupler throwers that results in a quality thrower.

2. Related Art

Sand casting is one of the earliest forms of casting, primarily for casting a body, knuckle and lock of a railcar coupler. Its popular use is due to its low cost and the simplicity of materials involved. A sand casting or a sand molded casting is a cast part produced through the following process: (1) placing a pattern in sand to create a mold, which incorporates a gating system; (2) removing the pattern; (3) filling the mold cavity with molten metal; (4) allowing the metal to cool; (5) breaking away the sand mold and removing the casting (also referred to as the shake-out process); and (6) finishing the casting, which may include weld repair, grinding, machining, and/or heat treatment operations.

In sand casting, the primary piece of equipment is the mold, which contains several components. The mold is divided into two halves—the cope (upper half) and the drag (bottom half), which meet along a parting line. The sand mixture is packed around a master "pattern" forming a mold cavity, which is an impression of the shape being cast. The sand is usually housed in what casters refer to as flasks, which are boxes without a bottom or lid, used to contain the sand. The sand mixture can be tamped down as it is added and/or the final mold assembly is sometimes vibrated to compact the sand and fill any unwanted voids in the mold. The sand can be packed by hand, but machines that use pressure or impact ensure even packing of the sand and require far less time, thus increasing the production rate. The pattern is removed, leaving the mold cavity. Cores are added as required, and the cope is placed on top of the drag.

In addition to the external and internal features of the casting, other features are incorporated into the mold to accommodate the flow of molten metal. The molten metal is poured into a pouring basin, which is a large depression in the top of the sand mold. The molten metal funnels out of the bottom of this basin and down the main channel, called the sprue (or down sprue). The sprue connects to a series of channels, called runners that carry the molten metal into the cavity. At the end of each runner, the molten metal enters the cavity through a gate (or ingate) that controls the flow rate and minimizes turbulence. Chambers called risers that fill with molten metal are often connected to the runner system. Risers provide an additional source of metal during solidification. When the casting cools, the molten metal shrinks and the additional material in the gate and risers acts to back fill into the cavities as needed. The molten metal that flows through all of the channels (sprue, runners, and risers) will solidify attached to the casting and must be separated from the part after it is removed. Molten metal is poured into the mold cavity, and after it cools and solidifies, the casting is separated from the sand mold.

Because the coupler thrower is a relatively small, simple part, historically this part has typically been forged, not cast.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION

In some cases, well known structures, materials, or operations are not shown or described in detail. Furthermore, the described features, structures, or characteristics may be combined in any suitable manner in one or more embodiments. It will also be readily understood that the components of the embodiments as generally described and illustrated in the Figures herein could be arranged and designed in a wide variety of different configurations.

Figure 1:
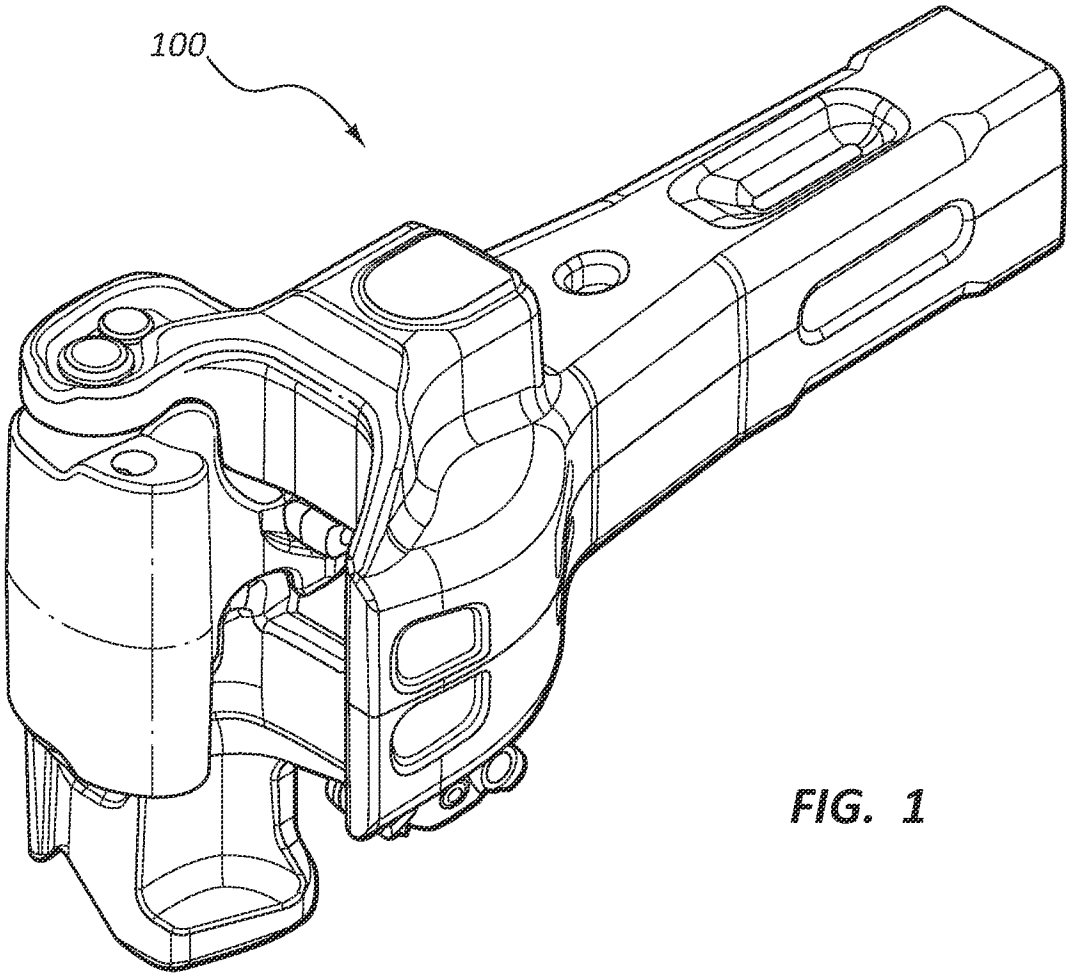
FIG. 1 is a perspective view of a cast railroad coupler including the thrower (not shown, but located inside the coupler).

The Association of American Railroads (AAR) coupler 100, shown in FIG. 1, is an assembly of parts, all of which are required to interact in a precise manner for the coupler assembly to operate properly and to have optimum part life. Operating positions include locked, unlocked, and lockset. Since coupler parts are often replaced during the service life of a coupler, the interchange of parts must maintain the proper interfacing dimensions for proper operation. Therefore, control of the dimensional tolerances of coupler parts help ensure proper operation.

The coupler also transmits the longitudinal forces pulling and pushing a railcar in service operations. These forces can be of significant magnitude—often many hundreds of thousands of pounds—and require that the load path of force through the coupler assembly be precisely controlled. Design loads per the AAR Specification M-211 reach 650,000 pounds for the knuckle and 900,000 pounds for the coupler body. Uniform loading helps ensure uniform wear patterns and in turn more uniform load distribution. Finally, the strength of the coupler and its fatigue life may prevent premature failure of parts, which is directly influenced by dimensional tolerance consistency and consequently the level of uniform load distribution.

Figure 2:
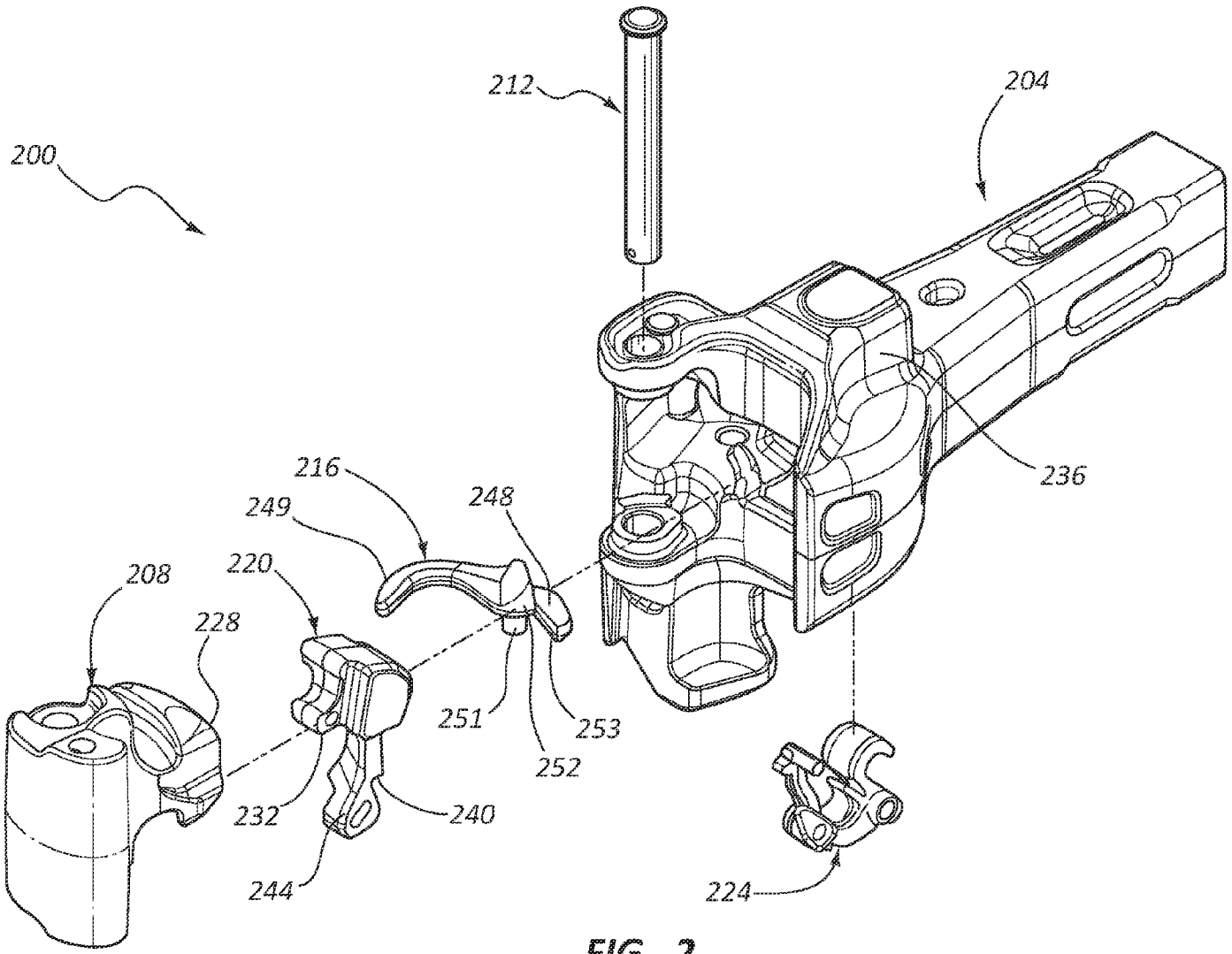
FIG. 2 is a perspective, exploded view of a coupler assembly used to form the railroad coupler of FIG. 1.

FIG. 2 displays the major parts of a railroad coupler assembly 200, including a body 204, a knuckle 208, a knuckle pin 212, a thrower 216, a lock 220, and a locklift 224. Of these major parts, the knuckle 208 and the body 204 are usually produced using a casting process such as green sand casting. Due to their small sizes, the lock 220, the thrower 216, and the locklift 224 assembly can be produced by various methods such as casting or by forging. As disclosed herein, the thrower 216 can also be produced by a sand casting process or through a cold shell technique that is part of the general category of shell molding. One type of cold shell molding that may be used includes an Isocure® core system. Casting by the cold shell, or no-bake process, carries with it certain advantages over green sand casting. These include having a better (smoother) finish, tighter dimensional tolerances and more consistent parts coming out of the same molds. These advantages mean that the throwers produced need not undergo machining operations to the trunnion or other part of the thrower as was done with previously-cast or forged throwers. Additional advantages are discussed in more detail by a related application owned by the Assignee of the current disclosure entitled "Use of No-Bake Mold Process to Manufacture Railroad Couplers," patent application Ser. No. 12/685,346, filed Jan. 11, 2010, which is hereby incorporated by reference in its entirety.

During the locking and unlocking operations, the knuckle 208 rotates about the axis of the knuckle pin 212. The knuckle tail 228 must pass under the knuckle shelf seat 232 on the lock 220 during the locking and unlocking operations. The lock must also move downward and upward in a lock chamber 236 of the body 204 during the locking and unlocking operations. Also, during lockset, the lock 220 must move upward in the lock chamber 236 of the body such that a lockset seat 240 on a lock leg 244 sits with precision on a leg-lock seat 248 of the thrower 216. The thrower 216 further includes a knuckle actuating leg 249, a trunnion 251 and a hub 252, which is located in the middle of the thrower 216 adjacent the trunnion 251. The leg-lock seat 248 includes a lock actuating surface 253.

The parts of the coupler assembly 200, including the thrower 216, should have accurate dimensional characteristics to ensure successful operation. The better the dimensional characteristics, the smoother the operation. The larger the dimensional variation, the rougher the operation, and if large enough, the parts will jam and the coupler may become inoperable. Smooth surface finishes also aid in successful operation, which is improved with the use of sand casting, but even more so with no-bake or cold shell casting. If the tolerances of the parts are too large, interference can occur when the knuckle 208 is rotating relative to the body 204 and the lock 220. This interference can result in sticking conditions making difficult the operations of locking and unlocking the coupler. In some cases, extremes of tolerances in relative part dimensions have resulted in coupler inoperability and/or an inability to interchange parts.

Figure 3:
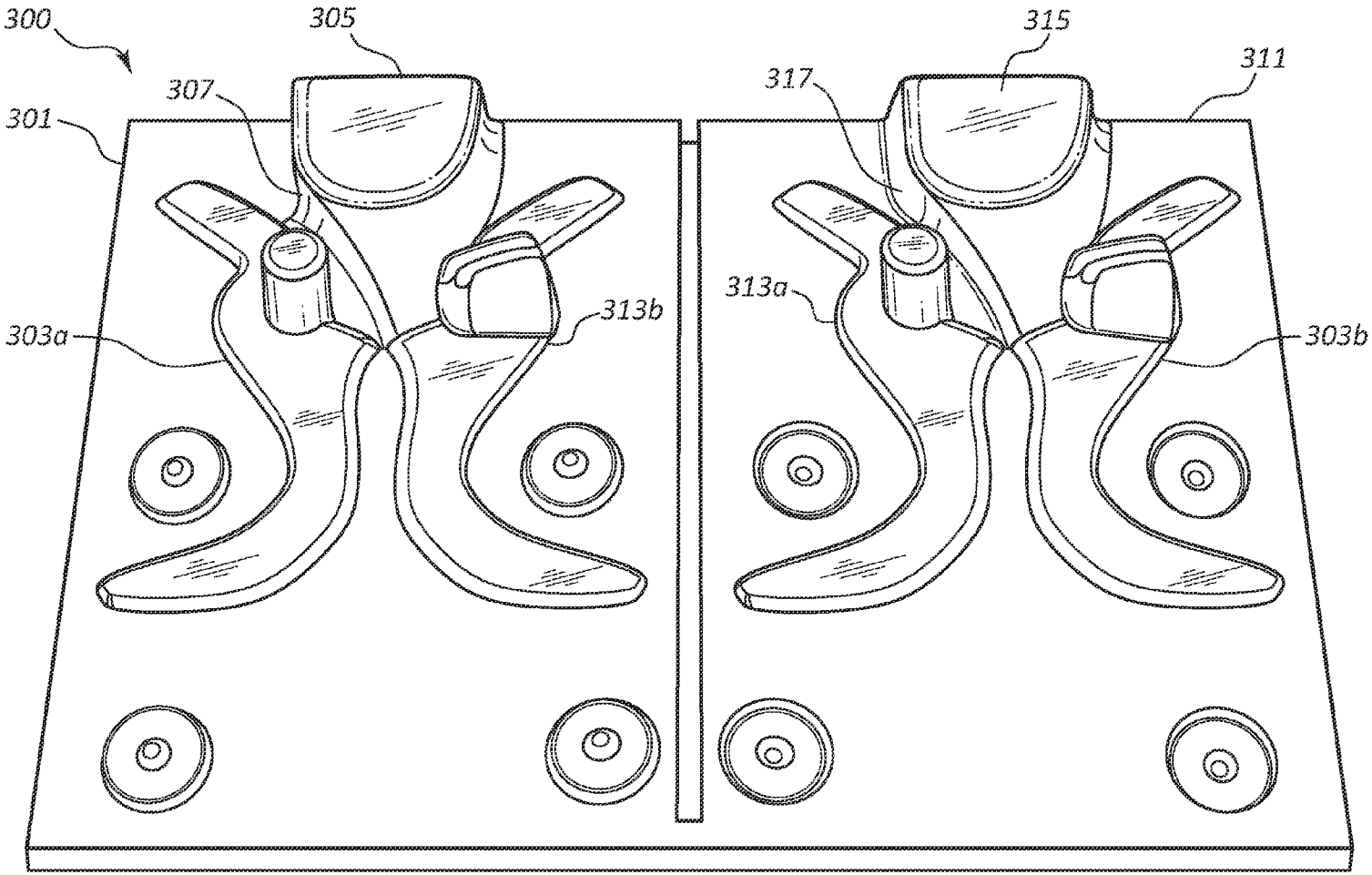
FIG. 3 is a perspective view of a pattern to create a mold to cast two throwers such as the thrower of FIG. 2.
Figure 4:
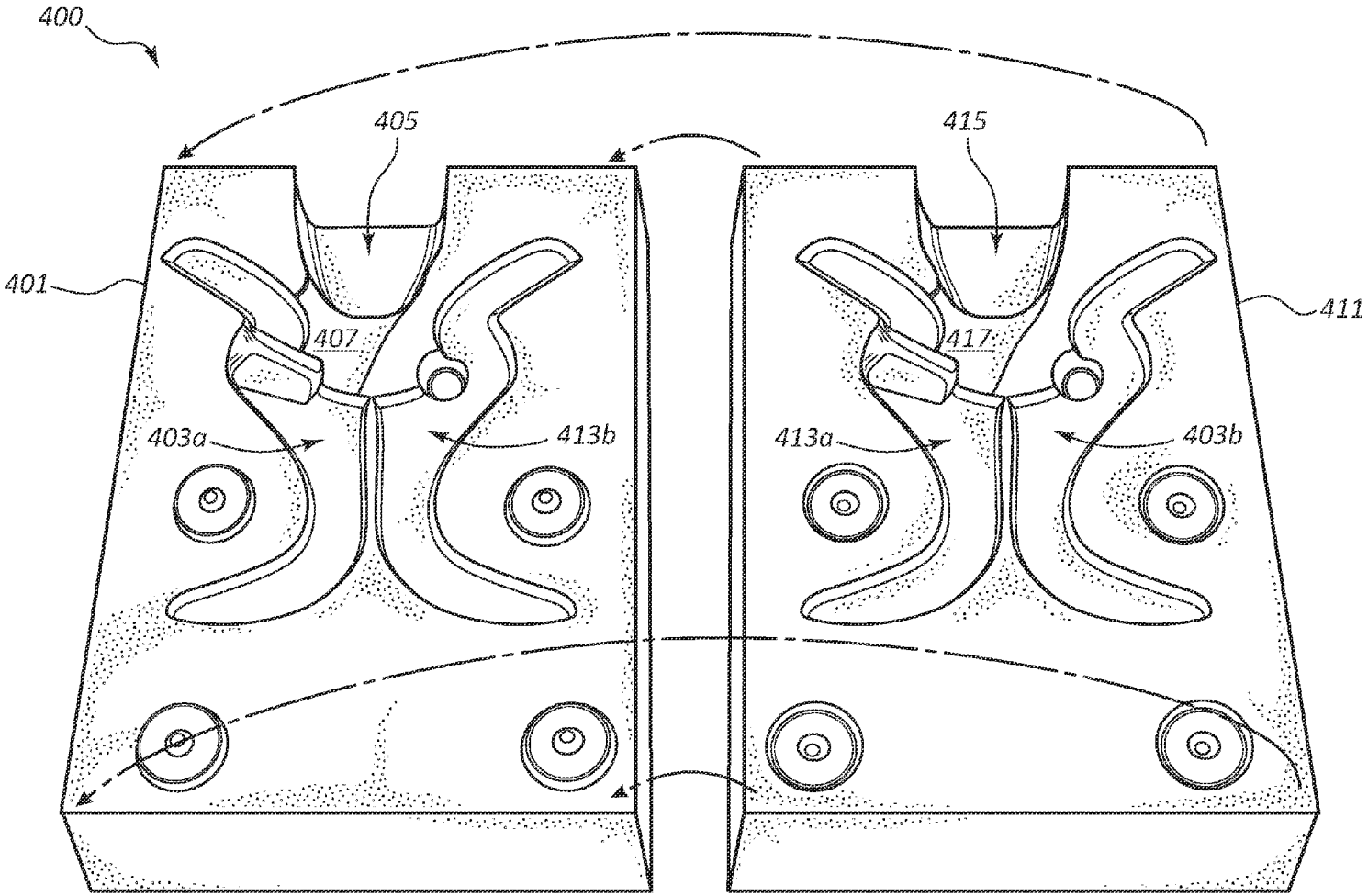
FIG. 4 is a perspective view of the two mold halves created from the pattern of FIG. 3.

FIG. 3 displays a pattern 300 to create a mold (FIG. 4) to cast two throwers 216 such as the thrower 216 of FIG. 2. The pattern 300 includes two halves 301, 311 including reflective images of two sides of thrower cavities to cast two throwers. The pattern 300, could include only one side per half of the pattern to cast a single thrower, but the pattern 300 displayed in FIG. 2 can make a mold to cast twice as many throwers simultaneously, form the same mold. More specifically, the first half 301 includes a side 303*a* to define part of a first thrower cavity and a side 313*b* to define a part of a second thrower cavity. The second half 311 includes a side 303*b* to define the other part of the first thrower cavity and a side 313*a* to define the other part of the second thrower cavity. To say that the thrower sides 303*a*, 313*b* and 303*b*, 313*a* of the pair of thrower cavities are reflective images of each other on respective halves 301, 311 is to say that they substantially match up when a mold 400 from the pattern 300 is folded in half (FIG. 4). The matching creates two full throwers 216 when the mold from the pattern 300 is used in casting, where the throwers 216 meet or exceed industry standards for dimensional tolerances.

Furthermore, the first half 301 of the pattern includes a raised portion 305 to define part of a cup-shaped sprue cavity and the second half 311 of the pattern includes a raised potion 315 to define the rest of the sprue cavity. These raised portions 305, 315 for the sprue cavity are located above the thrower sides to connect the outer surface of the mold created from the pattern 300 to the thrower cavities. The thrower sides 303*a*, 313*b* and 303*b*, 313*a* of the pattern halves 301, 311 are oriented vertically with first ends (knuckle actuating legs 249 area) down and second ends (leg lock seats 248 area) up, which could be reversed in alternative embodiments. Accordingly, the raised portions 305, 315 define a sprue cavity that feed molten metal, with the help of gravity, to the thrower cavities defined by the reflective thrower sides. This helps cast the thrower with the mold that is created by the pattern 300: the molten metal flows evenly to first fill up the first ends of the thrower cavities (farthest from the sprue cavity) before filling up the second ends.

Additionally, the first half 301 of the pattern 300 may include an angled imprint 307 to define a first ingate that receives molten metal from the sprue and feeds the molten metal to the hub of a thrower cavity. The second half 311 of the pattern 300 may include an angled imprint 317 to define a second ingate that receives molten metal from the sprue and feeds the molten metal to the hub of the other thrower cavity (of the two thrower cavities). The angled imprints 307, 317 may feed a flat section of either side of the respective hubs of the thrower cavities.

In terms of the cold shell system, in one example, mold boxes are vertically or horizontally parted with the two halves separated and blown, not as one piece, but as individual halves within the same mold box. The sand may be mixed and packed (or blown) into the box cavity using the pattern 300, followed by curing with an amine gas. In another example, the pattern could be molded without use of the mold boxes as is known in the art. The design of the mold is very efficient, providing a sand-to-metal ratio by weight of 0.9:1. After the curing process is complete, two halves 401, 411 of the mold 400 (FIG. 4) are ejected onto a belt—or are pushed down rails—for further processing. Once the two halves 401, 411 are finished, each is cleaned and clamped vertically using small spring clips or clamps (not shown) to hold the halves together.

Figure 5:
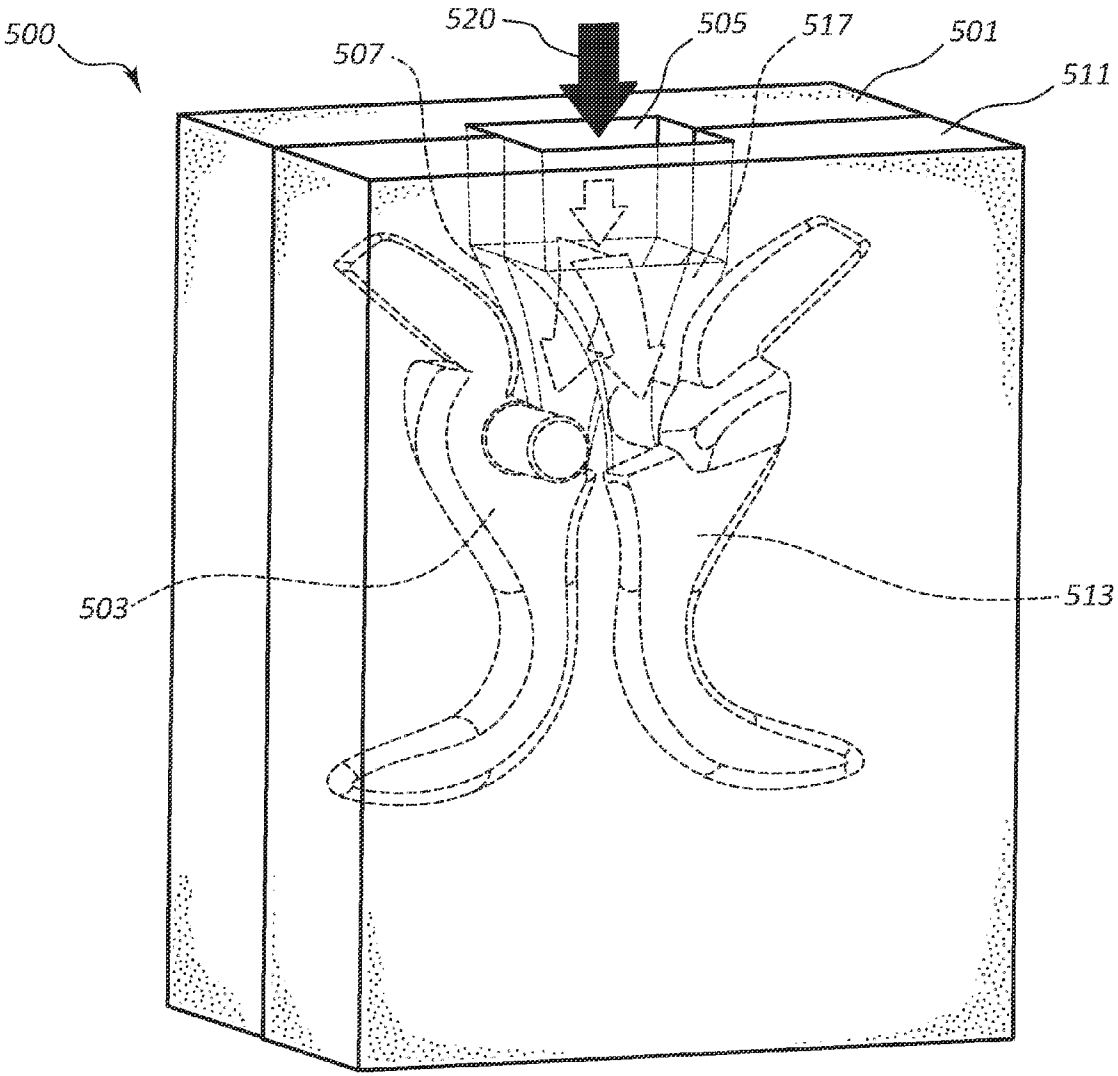
FIG. 5 is a perspective, see-through view of the mold halves of FIG. 4 ready for simultaneously casting of two throwers.

FIG. 4 displays a mold 400 including two mold halves 401, 411 created from the pattern of FIG. 3 including reflective images of two sides of thrower cavities to cast two throwers 216. FIG. 5 shows the mold halves 401 and 411 of FIG. 4 folded in a mold 500 ready for casting two throwers. If only a single thrower were defined by the pattern 300, then the mold 400 would only form a single thrower cavity, which could come from a mold that looks like the mold 400 cut in half through the center. In the displayed embodiment of FIGS. 4 and 5, the mold 400, 500 includes two thrower cavities with which to cast two throwers 216. Additional molds may be created based on the present disclosure that provide for simultaneously casting more than two throwers 216 at the same time.

More specifically, the first half 401, 501 of the mold includes a side 403*a* of a first thrower cavity 503 and a side 413*b* of a second thrower cavity 513. The second half 411, 511 of the mold includes the other side 403*b* of the first thrower cavity 503 and the other side 413*a* of the second thrower cavity 513. The first half 401, 501 of the mold also includes a portion 405 of a cup-shaped sprue cavity 505 and the second half 411, 511 of the mold includes the rest 415 of the sprue cavity 505. Each of the first and second halves 401, 411 of the mold 400 also includes an angled ingate 407/507, 417/517, respectively, which connects the sprue 505 to respective thrower cavities 503 and 513. The ingates 407, 417 and 507, 517 could alternatively feed the other of the respective thrower cavities 513 and 503 in another embodiment. The ingates 407, 417 and 507, 517 may be formed such that they connect into the hub 252 of each respective thrower cavity 403, 413 and 503, 513.

With further reference to FIG. 5, molten metal enters at arrow 520, passing through the sprue 505. The sprue acts as the riser for casting in funneling the molten metal directly into the thrower cavities 503, 513 and providing an additional source of metal during solidification. Accordingly, open risers provide a source of metal to compensate for shrinkage and prevent early solidification by facilitating flow-through of the metal. The molten metal passes through the ingates 507, 517 to fill up respective thrower cavities 503, 513, filling the first ends (knuckle actuating legs 249 area) before the second ends (leg lock seats 248 area). Of course, the thrower cavities 503, 513 could be oriented upside down to what is shown so that the second ends are filled up before the first ends. The ingates 507, 513 may feed into the hubs 252 of the thrower cavities 503, 513. The hubs 252 correspond to the center sections of the thrower cavities 503, 513 located between their first and second ends.

The vertical pouring allows for the best directional solidification because the mold 500 will feed itself with molten metal from the bottom to the top. The molten steel flows to the bottom of the mold 500 where it starts to fill up the thrower cavities 503, 513 starting at the tip of the thrower legs 249 and working its way back up to the sprue 505 (or riser) once the entire cavities forming the shapes of the throwers are filled. Since the metal at the bottom tip of the thrower leg 249 was filled first, it will cool first forming the exact dimensions provided by the mold. This solidification process will take place working its way back up to the sprue 505 (or riser) where the molten metal will retain a very hot temperature until the entire thrower mold cavity is filled. There will be no sections of the thrower that solidifies first above the lower tip that would prevent molten metal from feeding the thrower mold as it solidifies. The sprue 505 (riser) on the top will continue to feed the throwers 216 being cast as the last area of solidification occurs at the top of the casting. This is an ideal sequence of pouring and solidification for a cast part.

Figure 6:
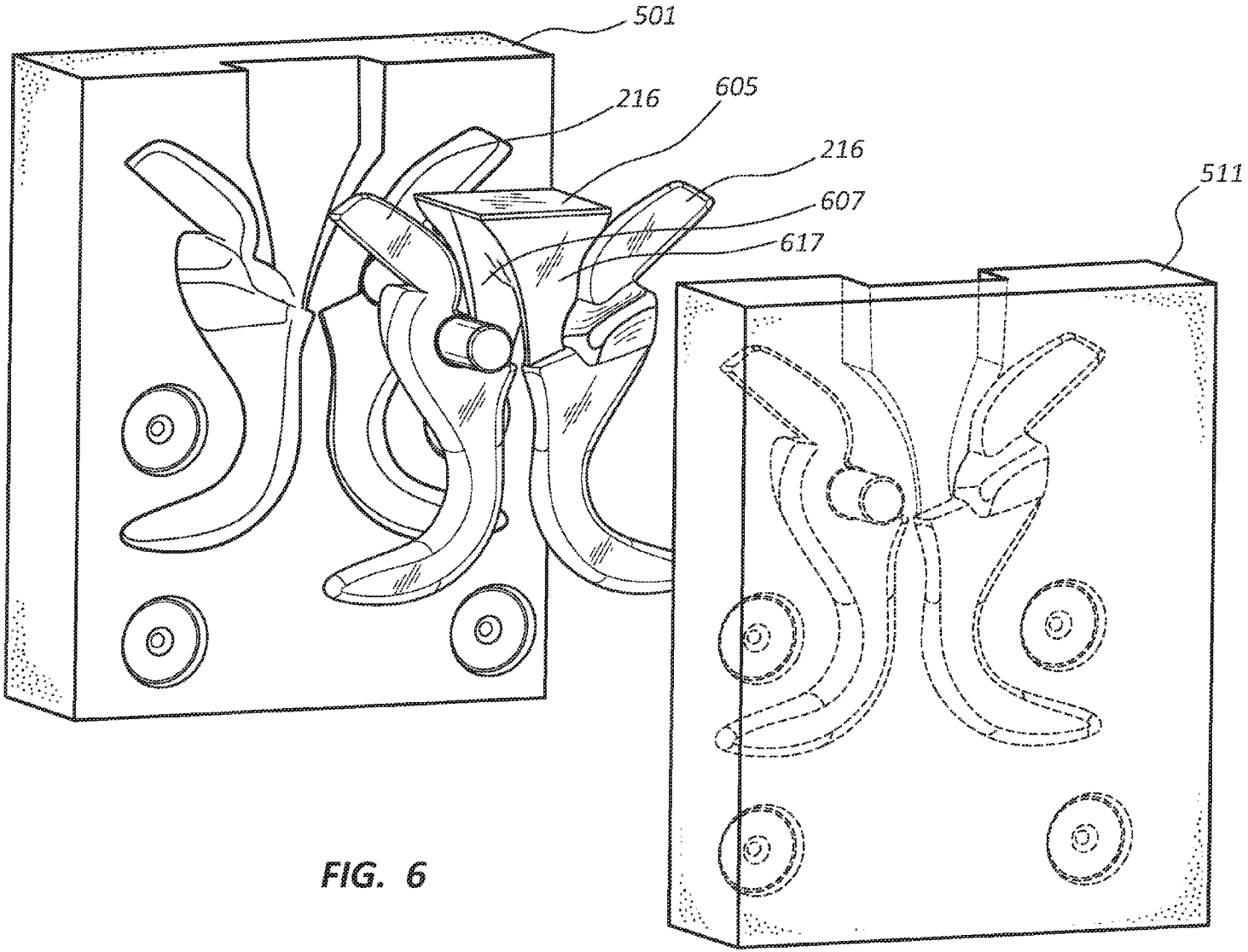
FIG. 6 is an exploded view of the mold halves of FIG. 5 being separated to release the cast throwers.

While FIG. 6 shows the mold halves 501, 511 of FIG. 5 being separated to release the cast throwers, the mold halves 501, 511 in reality would not be separated cleanly as shown, but would be shaken to release the sand and leave behind. What results are the two cast throwers 216 joined at their respective hubs 252 by filled ingates 607 and 617 and what exists of a filled sprue 605. The filled ingates 607 and 617 and sprue 605 are removed from the two throwers 216, which are shot blasted to clean the throwers 216. The throwers 216 may be heat treated and blasted a second time, if necessary. The throwers 216 that result from the disclosed processes meet AAR standard tolerances and do not need machining such as to the trunnion as is common with throwers 216 produced by forging or casting by the green sand process.

The terms and descriptions used herein are set forth by way of illustration only and are not meant as limitations. Those skilled in the art will recognize that many variations can be made to the details of the above-described embodiments without departing from the underlying principles of the disclosed embodiments. For example, the steps of the methods need not be executed in a certain order, unless specified, although they may have been presented in that order in the disclosure. The scope of the invention should, therefore, be determined only by the following claims (and their equivalents) in which all terms are to be understood in their broadest reasonable sense unless otherwise indicated.

The invention claimed is:

1. A method for casting at least one thrower for a railcar coupler, comprising:

creating a mold box that is vertically parted in halves, each half defining respective sides of two thrower cavities and that includes: at least a portion of a sprue at a location above the thrower cavities; and an ingate connected between the sprue and one of the two thrower cavities, the thrower cavities also being oriented vertically;

pouring molten metal into the mold box through the sprue and into the thrower cavities while the mold is oriented vertically, such that the molten metal passes through each of the ingates into respective hubs of the two thrower cavities, to cast the two throwers simultaneously; and shaking out the mold box to release the at least one thrower after the at least one thrower has cooled.

2. The method of claim 1, where creating the mold box comprises creating the mold box through a cold shell process.

3. The method of claim 1, where the ingates extend, at an angle, from the sprue into hubs of each respective thrower cavity.

4. The method of claim 1, where a sand to metal ratio by weight of the mold comprises 0.9:1.

5. A thrower for a railcar coupler created through the method of claim 1, the thrower having a surface finish and dimensional tolerances such that machining the trunnion is not required before the thrower is put into use.

6. A method for casting two throwers for a railcar coupler, comprising:

creating a mold box that includes two vertical halves, each half including a substantially reflective image of sides of two thrower cavities oriented vertically in the mold box, each half further including at least a portion of a sprue that communicates between an outer surface of the box and the thrower cavities, where the mold box further includes an ingate in each half of the mold box, each ingate connected between the sprue and one of the respective thrower cavities;

pouring molten metal through the sprue to substantially fill the two thrower cavities while the mold is oriented vertically, such that the molten metal passes through each of the ingates into respective thrower cavities, to cast the two throwers simultaneously; and shaking out the mold box to release the two throwers after the throwers have cooled.

7. The method of claim 6, where the at least a portion of the sprue is positioned above the vertically-oriented thrower cavity, such that molten metal fills a first end of the two thrower cavities farthest from the sprue before filling a second end of the two thrower cavities.

8. The method of claim 6, where the ingates are angled to connect the sprue with hubs of each respective thrower cavity.

9. The method of claim 6, where the creating the mold box comprises creating the mold box through a cold shell process.

10. A thrower for a railcar coupler created through the method of claim 6, the thrower having a surface finish and dimensional tolerances such that machining the trunnion is not required before the thrower is put into use.

11. A pattern to create a mold box for forming a thrower for a railcar coupler, comprising:

two halves substantially defining reflective images of respective sides of cavities of two throwers and at least a portion of a sprue located above each side of the thrower cavities, so that two throwers can be cast at the same time; and an angled imprint defined in each half, each angled imprint corresponding to an ingate that connects the sprue to one of the thrower cavities, where the thrower cavities are oriented vertically with the sprue above the thrower cavities so that the mold box receives molten metal through the sprue and fills a first end of the thrower cavities farthest from the sprue before filling a second end of the thrower cavities.

12. The pattern of claim 11, where the reflective image of each thrower is flipped so that one thrower cavity is oriented opposite to the other thrower cavity with respect to a vertical line bisecting the sprue.

13. The pattern of claim 11, where each respective ingate angles to feed a hub of the respective thrower cavity.

14. A pattern to create a mold box for forming a thrower for a railcar coupler, comprising:

two halves substantially defining reflective images of respective sides of cavities of two throwers and at least a portion of a sprue located above each side of the thrower cavities so that two throwers can be cast at the same time, where the reflective image of each thrower is flipped so that one thrower cavity is oriented opposite to the other thrower cavity with respect to a vertical line bisecting the sprue, and where the thrower cavities are oriented vertically with the sprue above the thrower cavities so that the mold box receives molten metal through the sprue and fills a first end of the thrower cavities farthest from the sprue before filling a second end of the thrower cavities.

15. The pattern of claim 14, further comprising:

an angled imprint defined in each half, each angled imprint corresponding to an ingate that connects the sprue to one of the thrower cavities.

16. The pattern of claim 14, where each of the two halves further define an ingate corresponding to one of the thrower cavities, the ingate connected between the sprue and the thrower cavity.

17. The pattern of claim 16, where each respective ingate angles to feed a hub of the respective thrower cavity.

* * * * *